US005186812A

United States Patent [19]

Shiohara et al.

[11] Patent Number: 5,186,812

[45] Date of Patent: Feb. 16, 1993

[54] METHOD FOR MANUFACTURING ZINC-SILICA COMPOSITE ELECTROPLATED STEEL SHEET

[75] Inventors: Yukimitsu Shiohara; Masaki Abe, both of Tokyo, Japan

[73] Assignee: NKK Corporation, Tokyo, Japan

[21] Appl. No.: 654,065

[22] Filed: Feb. 11, 1991

[30] Foreign Application Priority Data

Mar. 8, 1990 [JP] Japan ..... 2-57688
Mar. 13, 1990 [JP] Japan ..... 2-61960

[51] Int. Cl.[5] ..... C25D 7/06
[52] U.S. Cl. ..... 205/141
[58] Field of Search ..... 204/27, 55.1

[56] References Cited

FOREIGN PATENT DOCUMENTS 63-199899 8/1988 Japan .
62498 3/1989 Japan .
136995 5/1989 Japan .
159398 6/1990 Japan .

*Primary Examiner*—T. M. Tufariello
*Attorney, Agent, or Firm*—Frishauf, Holtz, Goodman & Woodward

[57] ABSTRACT

A method for manufacturing a zinc-silica composite electroplated steel sheet, which comprises the steps of: adding, to a zinciferous acidic electroplating solution containing silica particles and nitric acid ions, a complexing agent, which is capable of forming a stable complex with zinc, in an amount within a range of from 0.001 to 10 moles per liter of the electroplating solution, or a pH buffer, which has a pH buffering effect in a solution having a pH value within a range of from 5 to 12, in an amount within a range of from 1 to 50 g per liter of the electroplating solution; and electroplating a steel sheet in the resultant electroplating solution containing the complexing agent of the pH buffer in addition to the silica particles and the nitric acid ions, to form, on the surface of the steel sheet, a zinciferous plating layer in which silica particles are uniformly dispersed.

10 Claims, No Drawings

METHOD FOR MANUFACTURING ZINC-SILICA COMPOSITE ELECTROPLATED STEEL SHEET

REFERENCE TO PATENTS, APPLICATIONS AND PUBLICATIONS PERTINENT TO THE INVENTION

As far as we know, there is available the following prior art document pertinent to the present invention:

Japanese Patent Provisional Publication No. 63-199,899 dated Aug. 18, 1988.

The contents of the prior art disclosed in the above-mentioned prior art document will be discussed hereafter under the heading of the "BACKGROUND OF THE INVENTION".

FIELD OF THE INVENTION

The present invention relates to a method for manufacturing a zinc-silica composite electroplated steel sheet excellent in corrosion resistance and workability, having on at least one surface thereof a zinciferous plating layer in which silica particles are uniformly dispersed.

BACKGROUND OF THE INVENTION

With a view to further improving corrosion resistance of a zinciferous electroplated steel sheet, trials are actively made to improve corrosion resistance of its zinciferous plating layer comprising zinc or a zinc alloy by uniformly dispersing silica particles into the plating layer. It is not however easy to cause uniform dispersion of the silica particles into the zinciferous plating layer. The reason is that the silica particles are negatively charged in a zinciferous acidic electroplating solution and have a tendency of hardly precipitating onto the surface of a steel sheet serving as a cathode.

As a method for solving the above-mentioned problem and manufacturing a zinc-silica composite electroplated steel sheet excellent in corrosion resistance, having, on at least one surface thereof, a zinciferous plating layer in which silica particles are uniformly dispersed, the following method is proposed:

A method for manufacturing a zinc-silica composite electroplated steel sheet, disclosed in Japanese Patent Provisional Publication No. 63-199,899 dated Aug. 18, 1988, which comprises the steps of: electroplating a steel sheet in a zinciferous acidic electroplating solution having a pH value within a range of from 1 to 4.5, which contains silica particles in an amount within a range of from 0.5 to 100 g per liter of the electroplating solution and nitric acid ions in an amount within a range of from 100 to 3,000 ppm, to form, on at least one surface of said steel sheet, a zinciferous plating layer in which silica particles are uniformly dispersed (hereinafter referred to as the "Prior Art").

According to the above-mentioned Prior Art, it is possible to manufacture a zinc-silica composite electroplated steel sheet excellent in corrosion resistance, having, on at least one surface thereof, a zinciferous plating layer in which silica particles are uniformly dispersed. As in the Prior Art, a zinciferous plating layer in which silica particles are uniformly dispersed can be formed on at least one surface of a steel sheet by electroplating the steel sheet in a zinciferous acidic electroplating solution containing silica particles and nitric acid ions, and the reason of this is estimated to be as follows:

When the steel sheet is electroplated in the zinciferous acidic electroplating solution containing silica particles and nitric acid ions, reactions as shown in the following equations (1) to (3) take place:

$$Zn^{2+} + 2OH^- \rightarrow Zn(OH)_2 \quad (1)$$

$$Zn(OH)_2 + 2e^- \rightarrow Zn + 2OH^- \quad (2)$$

$$NO_3^- + 9H^+ + 8e^- \rightarrow NH_3 + 3H_2O \quad (3)$$

The reduction reactions of zinc ions ($Zn^{2+}$) according to the equations (1) and (2) above cause the increase to 5.6 in the pH value of the zinciferous acidic electroplating solution on the interface of the cathode, i.e., the steel sheet, and the reduction reaction of nitric acid ions ($NO_3^-$) according to the equation (3) above further increases the above-mentioned pH value to over 5.6. This increase in the pH value of the electroplating solution on the interface of the cathode causes the silica particles to be absorbed by the zinc ions. This makes it easier for the silica particles, together with zinc, to be precipitated on the surface of the steel sheet as the cathode, thus increasing the rate of precipitation thereof. It is thus possible to form, on at least one surface of a steel sheet, a zinciferous plating layer excellent in corrosion resistance, in which the silica particles are uniformly dispersed.

However, the above-mentioned Prior Art has the following problems: As described above, the pH value of the electroplating solution on the interface of the cathode, i.e., the steel sheet increases to over 5.6 as a result of the reduction reaction of the nitric acid ions ($NO_3^-$) contained in the zinciferous acidic electroplating solution. The resultant increase in the rate of precipitation of the silica particles improves corrosion resistance of the zinciferous plating layer. However, when the rate of precipitation of the silica particles into the zinciferous plating layer increases excessively, workability of the zinc-silica composite electroplated steel sheet is degraded. The rate of precipitation of the silica particles, i.e., the content of the silica particles in the zinciferous plating layer, which can improve corrosion resistance without degrading workability, is within a range of from 0.2 to 15.0 wt. % relative to the zinciferous plating layer.

The content of the nitric acid ions in the zinciferous acidic electroplating solution sensitively affects the pH value of the electroplating solution on the interface of the cathode. When the pH value of the electroplating solution on the interface of the cathode decreases to 5.6 or under, the rate of precipitation of the silica particles into the zinciferous plating layer decreases to under 0.2 wt. % relative to the plating layer. When the above-mentioned pH value increases to over 12, on the other hand, the rate of precipitation of the silica particles increases to over 15.0 wt. % relative to the plating layer, thus degrading workability of the zinciferous electroplated steel sheet. Therefore, the range of the content of the nitric acid ions, which is capable of increasing the rate of precipitation of the silica particles without degrading workability, is very narrow.

Upon electroplating, it is very difficult to keep the content of the nitric acid ions in the electroplating solution within the narrow range which can increase the rate of precipitation of the silica particles without degrading workability. It is therefore very difficult to stably manufacture a zinc-silica composite electroplated steel sheet excellent in corrosion resistance and workability, having on at least one surface thereof a zinciferous plating layer in which silica particles are uniformly dispersed in an amount sufficient to improve corrosion resistance without degrading workability.

Under such circumstances, there is a strong demand for the development of a method for stably manufacturing a zinc-silica composite electroplated steel sheet excellent in corrosion resistance and workability, having on at least one surface thereof a zinciferous plating layer in which silica particles are uniformly dispersed in an amount sufficient to improve corrosion resistance without degrading workability, but such a method has not as yet been proposed.

SUMMARY OF THE INVENTION

An object of the present invention is therefore to provide a method for stably manufacturing a zinc-silica composite electroplated steel sheet excellent in corrosion resistance and workability, having on at least one surface thereof a zinciferous plating layer in which silica particles are uniformly dispersed in an amount sufficient to improve corrosion resistance without degrading workability.

In accordance with one of the features of the present invention, there is provided, in a method for manufacturing a zinc-silica composite electroplated steel sheet, which comprises the steps of: electroplating a steel sheet in a zinciferous acidic electroplating solution containing silica particles and nitric acid ions to form, on at least one surface of said steel sheet, a zinciferous plating layer in which silica particles are uniformly dispersed; the improvement wherein: said zinciferous acidic electroplating solution further contains a complexing agent, which is capable of forming a stable complex with zinc, in an amount within a range of from 0.001 to 10 moles per liter of said electroplating solution, or a pH buffer, which has a pH buffering effect in a solution having a pH value within a range of from 5 to 12, in an amount within a range of from 1 to 50 g per liter of said electroplating solution.

DETAILED DESCRIPTION OF PREFERRED EMBODIMENTS

From the above-mentioned point of view, extensive studies were carried out to develop a method for stably manufacturing a zinc-silica composite electroplated steel sheet excellent in corrosion resistance and workability, having on at least one surface thereof a zinciferous plating layer in which silica particles are uniformly dispersed in an amount sufficient to improve corrosion resistance without degrading workability. As a result, the following findings were obtained:

By electroplating a steel sheet in a zinciferous acidic electroplating solution containing a complexing agent in a prescribed amount or a pH buffer in a prescribed amount in addition to silica particles and nitric acid ions, there is inhibited the decrease to 5.6 or under and the increase to over 12 in the pH value of the electroplating solution on the interface of the cathode, i.e., the steel sheet. This expands the range of the content of nitric acid ions, which is capable of increasing the amount of precipitated silica particles without degrading workability.

The present invention was made on the basis of the above-mentioned findings. Now, the method of the present invention is described below.

In the present invention, when electroplating a steel sheet in a zinciferous acidic electroplating solution containing silica particles and nitric acid ions, there is added to the electroplating solution a complexing agent in an amount within a range of from 0.001 to 10 moles per liter of the electroplating solution, or a pH buffer in an amount within a range of from 1 to 50 g per liter of the electroplating solution.

By electroplating the steel sheet in the zinciferous acidic electroplating solution containing the complexing agent or the pH buffer in addition to the silica particles and the nitric acid ions, there is inhibited the decrease to 5.6 or under and the increase to over 12 in the pH value of the electroplating solution on the interface of the cathode, i.e., the steel sheet. As a result, the rate of precipitation of the silica particles into the zinciferous plating layer never decreases to under 0.2 wt. % nor increases to over 15.0 wt. % relative to the plating layer. Therefore, the range of the content of the nitric acid ions in the electroplating solution, which is capable of increasing the rate of precipitation of the silica particles is expanded without degrading workability.

The complexing agent should have the ability to form a stable complex with zinc. The ability of the complexing agent to form a stable complex with zinc means a degree of stability of the complex with zinc of at least 1.0 in a zinciferous acidic electroplating solution having a pH value of 6. With a complexing agent not having the ability to form a stable complex with zinc, i.e., a complexing agent having a degree of stability of under 1.0 of the complex with zinc in a zinciferous acidic electroplating solution having a pH value of 6, it is impossible to inhibit the decrease to 5.6 or under and the increase to over 12 in the pH value of the electroplating solution on the interface of the cathode.

A content of the above-mentioned complexing agent should be within a range of from 0.001 to 10 moles per liter of the zinciferous acidic electroplating solution. With a content of the complexing agent of under 0.001 mole per liter of the electroplating solution, it is impossible to inhibit the decrease to 5.6 or under and the increase to over 12 in the pH value of the electroplating solution on the interface of the cathode. With a content of the complexing agent of over 10 moles per liter of the electroplating solution, on the other hand, the electrolytic efficiency of the electroplating solution decreases, thus causing a burnt deposit and hence the problem of a deteriorated quality of the product.

Examples of the desirable complexing agent used in the present invention are presented below:

Ethylenediamine disodium tetraacetate (hereinafter referred to as "EDTA-Na");

Citric acid ions;

Oxalic acid ions;

Tartaric acid ions;

Trans-1. 2-cyclohexane-diamine-N.N.N'.N'-tetraacetic acid (hereinafter referred to as "CyDTA");

Diethylene triamine pentaacetic acid (hereinafter referred to as "DTPA"); and

Ethylenedioxybis (ethylamine)-N.N.N'.N'-tetraacetic acid (hereinafter referred to as "GEDTA").

The pH buffer should have a pH buffering effect in a solution having a pH value within a range of from 5 to 12. With a pH buffer having a pH buffering effect only in a solution having a pH value of under 5 or over 12, it is impossible to inhibit the decrease to 5.6 or under and the increase to over 12 in the pH value of the electroplating solution on the interface of the cathode.

A content of the above-mentioned pH buffer should be within a range of from 1 to 50 g per liter of the zinciferous acidic electroplating solution. With a content of the pH buffer of under 1 g per liter of the electroplating solution, it is impossible to inhibit the decrease to 5.6 or under and the increase to over 12 in the pH value of the electroplating solution on the interface of the cathode. With a content of the pH buffer of over 50 g per liter of the electroplating solution, on the other hand, no further improvement of the above-mentioned effect is available, leading to a higher cost.

Examples of the desirable pH buffer used in the present invention are presented below:

Clark-Lubs' pH buffer (hereinafter referred to as the "buffer A");

S ϕ rens' pH buffer (hereinafter referred to as the "buffer B");

Koltoff's pH buffer (hereinafter referred to as the "buffer C");

Michaelis' pH buffer (hereinafter referred to as the "buffer D");

Atkins-Pantin's pH buffer (hereinafter referred to as the "buffer E");

Palitzsch's pH buffer (hereinafter referred to as the "buffer F");

McIlvaine's pH buffer (hereinafter referred to as the "buffer G");

Menzel's pH buffer (hereinafter referred to as the "buffer H");

Walpeole's pH buffer (hereinafter referred to as the "buffer I");

Hasting-Sendroy's pH buffer (hereinafter referred to as the "buffer J");

Britton-Robinson's pH buffer (hereinafter referred to as the "buffer K");

Gomori's pH buffer (hereinafter referred to as the "buffer L");

Isotonic pH buffer (hereinafter referred to as the "buffer M"); and

N-ethylmorpholine-hydrochloric acid pH buffer (hereinafter referred to as the "buffer N").

In the present invention, a particle size of the silica particles which are dispersed into the zinciferous plating layer should preferably be limited to up to 1 μm. With a particle size of the silica particles of over 1 μm, it becomes difficult to cause uniform dispersion of the silica particles into the zinciferous plating layer, and a stable corrosion resistance of the zinciferous plating layer is unavailable. As the silica particles, it is preferable to use colloidal silica because of the easy handling when adding same to the zinciferous acidic electroplating solution.

A content of the silica particles in the zinciferous acidic electroplating solution should preferably be within a range of from 0.5 g to 100 g per liter of the electroplating solution. With a content of the silica particles of under 0.5 per liter of the electroplating solution, the rate of precipitation of the silica particles into the zinciferous plating layer decreases, thus making it impossible to give a high corrosion resistance to the zinciferous plating layer. With a content of the silica particles of over 100 g per liter of the electroplating solution, on the other hand, the electrolytic efficiency of the electroplating solution decreases.

As the nitric acid ions, nitric acid ($HNO_3$), sodium nitrate ($NaNO_3$), potassium nitrate ($KNO_3$), and zinc nitrate ($Zn(NO_3)_2$) are applicable. A content of the nitric acid ions in the zinciferous acidic electroplating solution should preferably be within a range of from 100 to 3,000 ppm. With a content of the nitric acid ions of under 100 ppm, the rate of precipitation of the silica particles into the zinciferous plating layer decreases, and a high corrosion resistance of the zinciferous plating layer is unavailable. With a content of the nitric acid ions of over 3,000 ppm, on the other hand, a dense zinciferous plating layer is unavailable.

A rate of precipitation of the silica particles, i.e., a content of the silica particles in the zinciferous plating layer should preferably be within a range of from 0.2 to 15.0 wt. % relative to the zinciferous plating layer. With a content of the silica particles in the zinciferous plating layer of under 0.2 wt. %, a high corrosion resistance of the zinciferous plating layer is unavailable. With a content of the silica particles in the zinciferous plating layer of over 15.0 wt. %, on the other hand, workability of the zinc-silica composite electroplated steel sheet is deteriorated to below that of the conventional electrogalvanized steel sheet.

In the present invention, the zinciferous plating layer, in which the silica particles are uniformly dispersed, may contain zinc as the only metallic constituent, or may additionally contain as required at least one of iron, nickel, cobalt and chromium.

A steel sheet on at least one surface of which the zinciferous plating layer having the uniformly dispersed silica particles is to be formed, may be a steel sheet not subjected to a surface treatment such as a cold-rolled steel sheet or a hot-rolled steel sheet, or a conventional electrogalvanized steel sheet, or a conventional zinc-alloy-plated steel sheet having a plating layer which contains, in addition to zinc, at least one of iron, nickel, cobalt and chromium.

As a basic plating solution, a sulfuric acid plating solution, a chloride plating solution or a mixed plating solution of sulfuric acid and chloride, which are all conventional, may be used. A conductivity assistant and/or a glossing agent may additionally be added to the above-mentioned basic plating solution, as required.

Now, the present invention is described more in detail by means of examples while comparing with examples for comparison.

EXAMPLE 1

A zinciferous acidic electroplating solution containing the silica particles and the nitric acid ions, and comprising the following constituents (hereinafter referred to as the "fundamental zinciferous electroplating solution") was used:

| | |
|---|---|
| zinc sulfate: | 300 g/l, |
| sodium sulfate: | 30 g/l, |
| sodium acetate: | 12 g/l, |
| colloidal silica: | 70 g/l, |
| sodium nitrate: | 1.6 g/l, |
| (1,167 ppm as nitric acid ions) | |
| pH value: | 2. |

A complexing agent was added to the above-mentioned fundamental zinciferous electroplating solution in an amount within the scope of the method of the present invention as shown in Table 1, to prepare zinciferous acidic electroplating solutions of the present invention (hereinafter referred to as the "electroplating solutions of the invention") Nos. 1 to 14. Then, a cold-rolled steel sheet having a thickness of 0.8 mm was electroplated in each of the electroplating solutions of the invention Nos. 1 to 14 under the following conditions, to form, on one surface of the cold-rolled steel sheet, a zinciferous plating layer in which silica particles were uniformly dispersed:

| | |
|---|---|
| (1) Electric current density: | 50 A/dm$^2$, and |
| (2) Weight of plating layer: | 40 g/m$^2$. |

For comparison purposes, no complexing agent was added, or a complexing agent in an amount outside the scope of the method of the present invention was added as shown also in Table 1, to the above-mentioned fundamental zinciferous electroplating solution, to prepare zinciferous acidic electroplating solutions outside the scope of the present invention (hereinafter referred to as the "electroplating solutions for comparison") Nos. 1 to 3. Then, a cold-rolled steel sheet having a thickness of 0.8 mm was electroplated in each of the electroplating solutions for comparison Nos. 1 to 3 under the same conditions as described above, to form, on one surface of the cold-rolled steel sheet, a zinciferous plating layer in which silica particles were uniformly dispersed.

TABLE 1

| No. | Complex agent kind | Complex agent Content (moles/l) | Tolerable range (ΔX) of sodium nitrate content (g/l) |
|---|---|---|---|
| Electroplating solution of the invention | | | |
| 1 | EDTA-Na | 0.0030 | 0.20 |
| 2 | EDT-Na | 0.1000 | 0.60 |
| 3 | Sodium citrate | 0.0050 | 0.15 |
| 4 | Sodium citrate | 0.0100 | 0.30 |
| 5 | Sodium citrate | 0.1000 | 1.00 |
| 6 | Sodium tartrate | 0.0050 | 0.05 |
| 7 | Sodium tartrate | 0.0100 | 0.10 |
| 8 | Sodium tartrate | 0.1000 | 0.50 |
| 9 | Sodium oxalate | 0.0050 | 0.04 |
| 10 | Sodium oxalate | 0.0100 | 0.10 |
| 11 | Sodium oxalate | 0.1000 | 0.40 |
| 12 | CyDTA | 0.0500 | 0.30 |
| 13 | DTPA | 0.0500 | 0.08 |
| 14 | GEDTA | 0.0500 | 0.08 |
| Electroplating solution for comparison | | | |
| 1 | — | — | 0.02 |
| 2 | EDTA-Na | 0.0005 | 0.01 |
| 3 | EDTA-Na | 12.0000 | 0.90 |

For each of the electroplating solutions of the invention Nos. 1 to 14 and the electroplating solutions for comparison Nos. 1 to 3, a tolerable range (ΔX), with 1.6 g/l as the standard, of the content of sodium nitrate in the electroplating solution was investigated. The tolerable range (ΔX) of the content of sodium nitrate means the range within which the content of the silica particles in the zinciferous plating layer is at least 0.2 wt. % which permits improvement of corrosion resistance, and workability of the zinc-silica composite electroplating steel sheet is never deteriorated to below that of the conventional electrogalvanized steel sheet having a plating weight of 40 g/m$^2$. Workability was evaluated, by bending a sample to a prescribed angle, sticking an adhesive tape onto the plating layer at the top of the bent portion, peeling off the adhesive tape, and measuring the amount of the thus peeled off portion of the plating layer at the top.

The above-mentioned tolerable range (ΔX) of the sodium nitrate content is shown also in Table 1. As shown in Table 1, the electroplating solution for comparison No. 1 not added with a complexing agent, showed a very narrow tolerable range of the sodium nitrate content of 0.02 g/l, and the electroplating solution for comparison No. 2 having a low content of the complexing agent outside the scope of the method of the present invention, showed also a very narrow tolerable range of the sodium nitrate content of 0.01 g/l. It was therefore impossible, according to the electroplating solutions for comparison Nos. 1 and 2, to stably manufacture a zinc-silica composite electroplated steel sheet excellent in corrosion resistance and workability. The electroplating solution for comparison No. 3 having a high content of the complexing agent outside the scope of the method of the present invention, while showing a wider tolerable range of the sodium nitrate content of 0.9 g/l, led to a poorer electrolytic efficiency of the electroplating solution and the production of a burnt deposit, thus resulting in a deteriorated quality of the product.

In contrast, each of the electroplating solutions of the invention Nos. 1 to 14 showed a wide tolerable range of the sodium nitrate content of at least 0.04 g/l, and never showed the decrease in an electrolytic efficiency of the electroplating solution or a deteriorated quality of the product caused by a burnt deposit. It was therefore possible, according to the electroplating solutions of the invention Nos. 1 to 14, to stably manufacture a zinc-silica composite electroplated steel sheet excellent in corrosion resistance and workability.

EXAMPLE 2

A pH buffer was added to the same fundamental zinciferous electroplating solution as in Example 1 in an amount within the scope of the method of the present invention as shown in Table 2, to prepare zinciferous acidic electroplating solutions of the present invention (hereinafter referred to as the "electroplating solutions of the invention") Nos. 15 to 35. Then, a cold-rolled steel sheet having a thickness of 0.8 mm was electroplated in each of the electroplating solutions of the invention Nos. 15 to 35 under the same conditions as in Example 1, to form, on one surface of the cold-rolled steel sheet, a zinciferous plating layer in which silica particles were uniformly dispersed.

For comparison purposes, no pH buffer was added, or a pH buffer in an amount outside the scope of the method of the present invention was added as shown also in Table 2, to the same fundamental zinciferous electroplating solution as in Example 1, to prepare zinciferous acidic electroplating solutions outside the scope of the present invention (hereinafter referred to as the "electroplating solutions for comparison") Nos. 4 to 6. Then, a cold-rolled steel sheet having a thickness of 0.8 mm was electroplated in each of the electroplating solutions for comparison Nos. 4 to 6 under the same conditions as in Example 1, to form, on one surface of the cold-rolled steel sheet, a zinciferous plating layer in which silica particles were uniformly dispersed.

TABLE 2

| No. | | pH buffer kind | Constituent | Content (g/l) | Tolerable range (ΔX) of sodium nitrate content (g/l) |
|---|---|---|---|---|---|
| Electroplating solution of the invention | 15 | A | Potassium hydrogen phthalete and sodium hydroxide | 10 | 0.4 |
| | 16 | A | Potassium dihydrogen phosphate and sodium hydroxide | 30 | 0.5 |
| | 17 | B | Sodium citrate and sodium hydroxide | 25 | 0.2 |
| | 18 | B | Sodium tetraborate and sodium hydroxide | 20 | 0.2 |
| | 19 | B | Potassium dihydrogen phosphate and sodium dihydrogen phosphate | 5 | 0.3 |
| | 20 | C | Potassium dihydrogen citrate and sodium hydroxide | 2 | 0.2 |
| | 21 | C | Succinic acid and sodium tetraborate | 3 | 0.1 |
| | 22 | C | Potassium dihydrogen citrate and sodium tetraborate | 25 | 0.2 |
| | 23 | C | Potassium dihydrogen phosphate and sodium tetraborate | 8 | 0.1 |
| | 24 | C | Sodium tetraborate and sodium carbonate | 5 | 0.2 |
| | 25 | C | Disodium hydrogen phosphate and sodium hydroxide | 20 | 0.1 |
| | 26 | D | Lactic acid and sodium lactate | 20 | 0.3 |
| | 27 | D | Potassium dihydrogen phosphate and disodium hydrogen phosphate | 15 | 0.1 |
| | 28 | G | Citric acid and disodium hydrogen phosphate | 30 | 0.25 |
| | 29 | H | Sodium carbonate and sodium hydrogencarbonate | 25 | 0.1 |
| | 30 | I | Acetic acid and sodium acetate | 20 | 0.2 |
| | 31 | J | Disodium hydrogen phosphate and Potassium dihydrogen phosphate | 15 | 0.15 |
| | 32 | K | Mixed acid solution and sodium hydroxide | 20 | 0.06 |
| | 33 | M | Potassium dihydrogen phosphate and sodium hydrogencarbonate | 10 | 0.11 |
| | 34 | M | Citric acid and disodium hydrogen phosphate | 15 | 0.09 |
| | 35 | M | Potassium dihydrogen phosphate and disodium hydrogen phosphate | 15 | 0.1 |
| Electro-plating solution for comparison | 4 | — | | — | 0.02 |
| | 5 | C | Sodium tetraborate and sodium carbonate | 0.5 | 0.03 |
| | 6 | C | Sodium tetraborate and sodium carbonate | 70 | 0.2 |

For each of the electroplating solutions of the invention Nos. 15 to 35 and the electroplating solutions for comparison Nos. 4 to 6, the tolerable range (ΔX) of the content of sodium nitrate in the electroplating solution was investigated as in Example 1. The results are shown also in Table 2.

As shown in Table 2, the electroplating solution for comparison No. 4 not added with a pH buffer, showed a very narrow tolerable range of the sodium nitrate content of 0.02 g/l, and the electroplating solution for comparison No. 5 having a low content of the pH buffer outside the scope of the method of the present invention, showed also a very narrow tolerable range of the sodium nitrate content of 0.03 g/l. It was therefore impossible, according to the electroplating solutions for comparison Nos. 5 and 6, to stably manufacture a zinc-silica composite electroplated steel sheet excellent in corrosion resistance and workability. The electroplating solution for comparison No. 6 having a high content of the pH buffer outside the scope of the method of the present invention, did not show a tolerable range of the sodium nitrate content improved over that in the electroplating solutions of the invention, thus resulting in a higher cost.

In contrast, each of the electroplating solutions of the invention Nos. 15 to 35 showed a wide tolerable range of the sodium nitrate content of at least 0.06 g/l, and never showed the decrease in the electrolytic efficiency of the electroplating solution or the deteriorated quality of the product caused by a burnt deposit. It was therefore possible, according to the electroplating solutions of the invention Nos. 15 to 35, to stably manufacture a zinc-silica composite electroplated steel sheet excellent in corrosion resistance and workability.

According to the present invention, as described above in detail, it is possible to stably manufacture a zinc-silica composite electroplated steel sheet excellent in corrosion resistance and workability, having on at least one surface thereof a zinciferous plating layer in which silica particles are uniformly dispersed in an amount sufficient to improve corrosion resistance without degrading workability, thus providing industrially useful effects.

What is claimed is:

1. In a method for manufacturing a zinc-silica composite electroplated steel sheet, which comprises the steps of:

electroplating a steel sheet in a zinciferous acidic electroplating solution containing silica particles and nitric acid ions to form, on at least one surface of said steel sheet, a zinciferous plating layer in which silica particles are uniformly dispersed;

the improvement wherein:

said zinciferous acidic electroplating solution further contains a complexing agent, which has a degree of stability of a complex with zinc of at least 1.0 in a zinciferous acidic electroplating solution having a pH value of 6, in an amount within a range of from 0.001 to 10 moles per liter of said electroplating solution.

2. The method as claimed in claim 1, wherein:

a content of said silica particles in said zinciferous acidic electroplating solution is within a range of from 0.5 to 100 g per liter of said electroplating solution.

3. The method as claimed in claim 1, wherein:

a particle size of said silica particles is up to 1 μm.

4. The method as claimed in claim 1, wherein:

a content of said nitric acid ions in said zinciferous acidic electroplating solution is within a range of from 100 to 3,000 ppm.

5. The method as claimed in claim 1, wherein:

a content of said silica particles in said zinciferous plating layer is within a range of from 0.2 to 15.0 wt. % relative to said zinciferous plating layer.

6. The method as claimed in claim 1, wherein the complexing agent is selected from the group consisting of ethylenediamine disodium tetraacetate, citric acid ions, oxalic acid ions, tartaric acid ions, trans-1,2-cyclohexane-diamine-N,N,N',N'-tetraacetic acid, diethylene triamine pentaacetic acid and ethylenedioxybis (ethylamine)-N,N,N',N'-tetraacetic acid.

7. The method as claimed in claim 6, wherein the nitric acid ions are from compounds selected from the group consisting of nitric acid, sodium nitrate, potassium nitrate and zinc nitrate and the content of nitric acid ions is 100 to 3,000 ppm.

8. The method as claimed in claim 7, which further comprises as a metallic constituent in addition to zinc, a metal selected from the group consisting of iron, nickel, cobalt and chromium.

9. The method as claimed in claim 8, wherein the electroplating solution is selected from the group consisting of a sulfuric acid plating solution, a chloride plating solution and a mixed plating solution comprising sulfuric acid and chloride.

10. The method as claimed in claim 9, wherein the silica particles have a particle size of up to 1 μm and are in a concentration of 0.5 to 100 g per liter of said electroplating solution and in an amount of 0.2 to 15 wt. % relative to said zinciferous plating layer.

* * * * *